US006648708B2

(12) United States Patent
Monks

(10) Patent No.: US 6,648,708 B2
(45) Date of Patent: Nov. 18, 2003

(54) APPARATUS AND METHOD FOR MEASURING CATHODE-RAY TUBE NECK ALIGNMENT AND TILT

(75) Inventor: Christopher Monks, Greensburg, PA (US)

(73) Assignees: Sony Corporation (JP); Sony Electronics Inc., Park Ridge, NJ (US)

( * ) Notice: Subject to any disclaimer, the term of this patent is extended or adjusted under 35 U.S.C. 154(b) by 211 days.

(21) Appl. No.: 09/879,154

(22) Filed: Jun. 13, 2001

(65) Prior Publication Data

US 2002/0193042 A1 Dec. 19, 2002

(51) Int. Cl.[7] ..... H01T 21/06

(52) U.S. Cl. ..... 445/3; 445/2; 445/61; 445/63; 445/68; 33/552; 33/554

(58) Field of Search ..... 445/3, 63, 68, 445/36, 24, 25, 26, 61, 2; 33/552, 554

(56) References Cited

U.S. PATENT DOCUMENTS 5,752,868 A 5/1998 Yabuki ..... 445/2
5,921,836 A * 7/1999 Nanto et al. ..... 445/24
6,033,281 A * 3/2000 Toro-Lira ..... 445/63
6,089,937 A 7/2000 Shoji ..... 445/2
6,108,924 A * 8/2000 Jang et al. ..... 33/552
6,254,448 B1 * 7/2001 Ho ..... 445/3
6,354,895 B1 * 3/2002 Van Riet ..... 445/3

* cited by examiner

*Primary Examiner*—Dean A. Reichard
*Assistant Examiner*—Ha Nguyen
(74) *Attorney, Agent, or Firm*—Rader, Fishman & Grauer PLLC

(57) ABSTRACT

An apparatus (20) for measuring alignment and tilt of a CRT neck (14) attached to a recycled CRT funnel portion (11) includes a support structure (21) that engages and supports a seal edge (24) of the CRT funnel portion (11), and a plurality of stopper pads (28–30) which engage respective alignment stoppers (34–36) molded on the CRT funnel portion (11). Distance measuring gauges (45–48) contact lower and upper points on two sides of the CRT neck (14). The alignment of the CRT neck (14) is determined by readings from the lower gauges (45, 47) on the first and second sides of the CRT neck (14). The tilt of the CRT neck (14) is measured by comparing the readings from the lower and upper gauges (45–48) on each of the first and second sides of the CRT neck. The stopper pads (28–30) on the support structure (21) can be changed to accommodate different sizes of CRT funnel portions (11, 11').

14 Claims, 8 Drawing Sheets

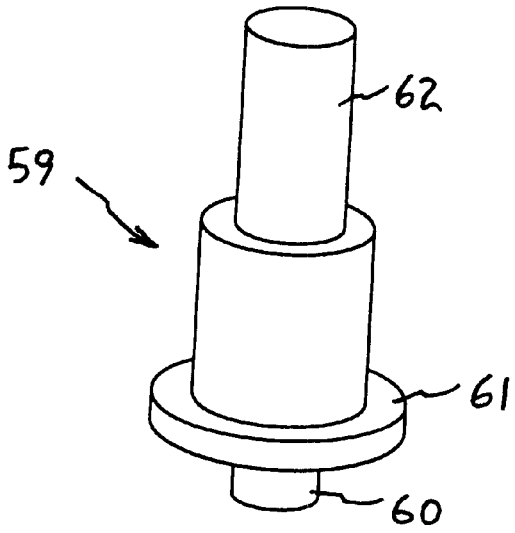
FIG. 10
FIG. 11
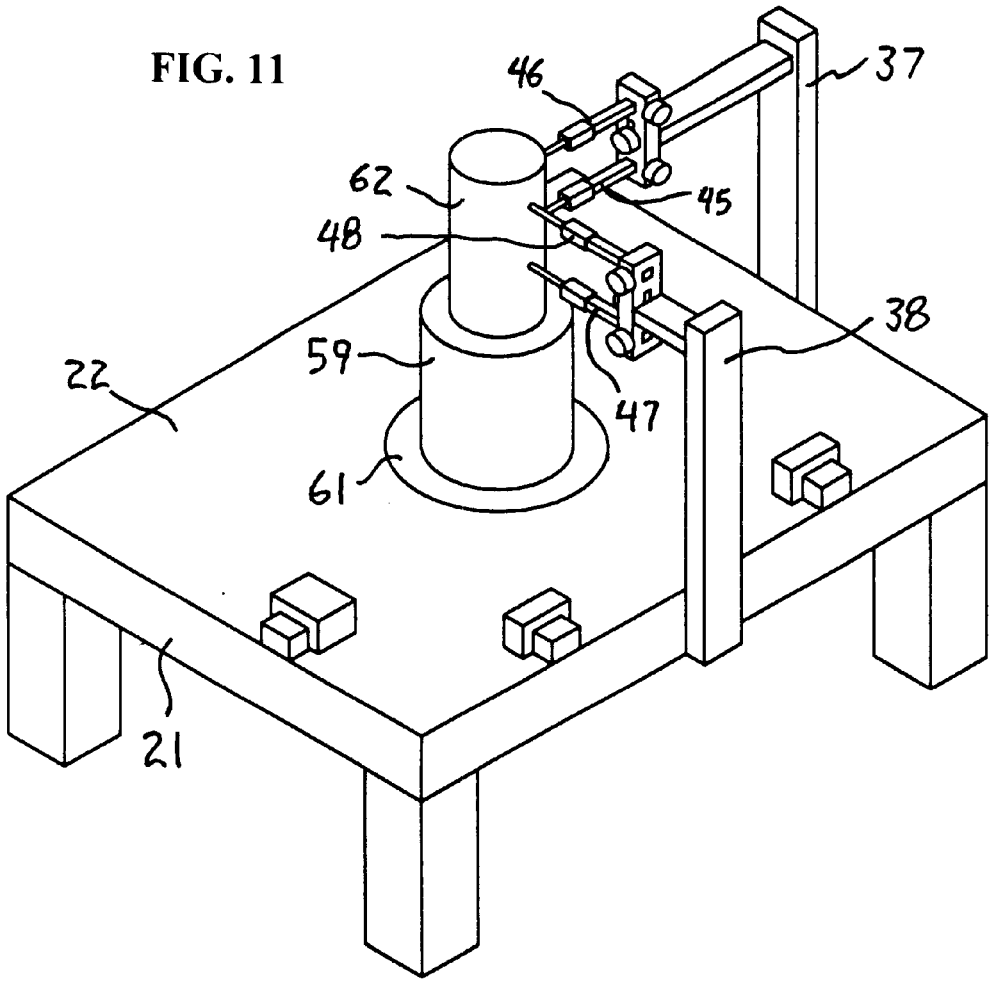

APPARATUS AND METHOD FOR MEASURING CATHODE-RAY TUBE NECK ALIGNMENT AND TILT

BACKGROUND OF THE INVENTION

1. Field of the Invention

The present invention relates generally to recycling of cathode-ray tubes ("CRTs"), and more particularly, to an apparatus and method for ensuring that the CRT neck is centered and not tilted after the CRT neck is attached to a recycled funnel.

2. Description of the Related Art

In recent years, there has been an increased demand for recycling of natural resources and prevention of environmental destruction. To meet this demand, studies and efforts have been made to reuse CRTs of used television sets and computer monitors.

A CRT, used as an image receiver incorporated in a television set, computer monitor, and the like, is a glass structure composed of a panel portion (also called a face portion) and a funnel portion (also called a panel skirt portion). The panel portion is made from a substantially transparent glass material for improving light transmittance, and the funnel portion is made from a glass material in which lead is mixed for preventing leakage of X-rays caused by collision of electron beams accelerated at a high voltage with a substance. The funnel portion and the panel portion are welded in a shield fashion to each other with frit glass (solder glass) into a tube shape.

An electron gun, a deflection yoke and the like are mounted on the external rear side of a CRT, and a shadow mask (or aperture grill) is provided in the CRT. A fluorescent screen provided on the inner surface side of the panel portion is normally coated with phosphors of three colors (red, green and blue).

Methods of recycling CRTs have been disclosed, for example, in U.S. Pat. Nos. 5,752,868 and 6,089,937. In these known methods, the CRTs are separated into a panel portion and a funnel portion, and the separate components are cleaned, inspected and recycled to make another CRT.

Part of the recycling process is to remove the electron gun, cut off the CRT neck, and re-attach a new CRT neck. When attaching the CRT neck to a recycled funnel, it is very important to ensure that the neck is centered and not tilted. An off center or tilted neck misaligns the electron gun that is inserted and causes a defective CRT.

CRT glass manufacturers use a 3-point system that takes various measurements around the neck in relation to the center of the funnel. Formulas are then applied to account for the thickness of the neck glass. However, in recycling, a quick and easy method was needed to accurately determine whether the new re-necked CRTs had the necks properly centered, aligned and not tilted.

SUMMARY OF THE INVENTION

It is an object of the present invention to provide an apparatus and method for ensuring that the CRT neck is centered and not tilted when the CRT neck is attached to a recycled funnel.

It is a further object of the present invention to provide an apparatus for measuring the alignment and tilt of CRT necks which is economical to manufacture, efficient in use, capable of a long operating life, and particularly well adapted for use in inspecting the alignment and tilt of CRT necks attached to recycled funnels.

According to the present invention, an apparatus and method are provided for measuring the alignment and tilt of CRT necks attached to recycled CRT funnel portions to determine whether the CRT necks are within acceptable tolerances. The apparatus includes a support structure having a first surface adapted to engage and support a seal edge of the CRT funnel portion, and a plurality of stopper surfaces extending from the support structure to engage the existing alignment stoppers molded on the CRT funnel portion. First and second distance measuring dial gauges engage lower and upper points, respectively, on a first side of the CRT neck being measured. Third and fourth distance measuring dial gauges engage lower and upper points, respectively, on a second side of the CRT neck. The alignment of the CRT neck is measured by taking readings at the lower points on each of the first and second sides of the CRT neck. The tilt of the CRT neck is measured by comparing the readings from the lower and upper points on each of the first and second sides of the CRT neck. The support structure has a plurality of alignment stoppers arranged to accommodate different sizes of CRT funnel portions.

According to a broad aspect of the present invention, an apparatus for measuring alignment and tilt of CRT necks attached to recycled CRT funnel portions is provided, comprising: a support structure having a first surface adapted to engage and support a seal edge of a CRT funnel portion; at least two stopper surfaces extending from the support structure and adapted to engage respective alignment stoppers molded on the CRT funnel portion to position the CRT funnel portion on the support structure; first and second distance measuring gauges mounted to the support structure, each of the first and second gauges having respective engagement portions adapted to engage the outer surface of a CRT neck being measured, the engagement portions of the first and second gauges being positioned on a first side of the CRT neck and facing the axial center line thereof with the first gauge being positioned below the second gauge; and third and fourth distance measuring gauges mounted to the support structure, each of the third and fourth gauges having respective engagement portions adapted to engage the outer surface of the CRT neck being measured, the engagement portions of the third and fourth gauges being positioned on a second side of the CRT neck and facing the axial center line thereof with the third gauge being positioned below the fourth gauge.

According to another broad aspect of the present invention, an apparatus for measuring alignment and tilt of a cylindrical member attached to a funnel-shaped member is provided, comprising: a support structure having a first surface adapted to engage and support the funnel-shaped member; at least two stopper surfaces connected to the support structure for engaging corresponding surfaces of the funnel-shaped member to position the funnel-shaped member on the support structure; first and second distance measuring gauges mounted to the support structure, each of the first and second gauges having respective engagement portions adapted to engage the outer surface of the cylindrical member being measured, the engagement portions of the first and second gauges being positioned on a first side of the cylindrical member and facing the axial center line thereof with the first gauge being positioned below the second gauge; and third and fourth distance measuring gauges mounted to the support structure, each of the third and fourth gauges having respective engagement portions adapted to engage the outer surface of the cylindrical member being measured, the engagement portions of the third and fourth gauges being positioned on a second side of the cylindrical member and facing the axial center line thereof with the third gauge being positioned below the fourth gauge.

According to another broad aspect of the present invention, a method of measuring alignment and tilt of CRT necks attached to recycled CRT funnel portions is provided, comprising the steps of: providing a first CRT funnel portion having a glass seal edge and first, second and third alignment stoppers molded on the glass seal edge, and a CRT neck attached to the first CRT funnel portion; providing a support structure having a support surface, a first set of alignment surfaces, and four distance measuring gauges; placing the first CRT funnel portion on the support structure with the seal edge on the support surface and the first, second and third alignment stoppers engaged with the first set of alignment surfaces, respectively; measuring an alignment of the CRT neck relative to the seal edge using the distance measuring gauges; and measuring a tilt of the CRT neck relative to the seal edge using the distance measuring gauges.

Numerous other objects of the present invention will be apparent to those skilled in this art from the following description wherein there is shown and described an embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings:

FIG. 10 is a perspective view of a calibration post used to calibrate the gauges for measuring tilt on the measuring apparatus shown in FIG. 5

FIG. 11 is a perspective view of the calibration post positioned on the measuring apparatus for calibrating the gauges.

DETAILED DESCRIPTION OF THE INVENTION

An apparatus and method for measuring neck alignment and tilt of CRT necks according to the present invention will be described below with reference to FIGS. 1 to 12 of the accompanying drawings.

Figure 1:
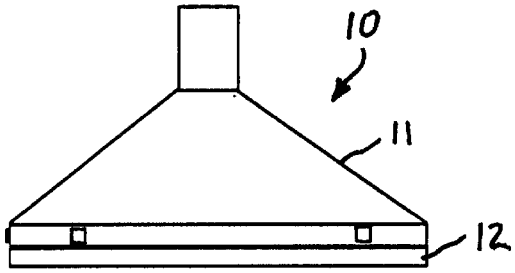
FIG. 1 is an elevation view of an intact CRT to be recycled.
Figure 2:
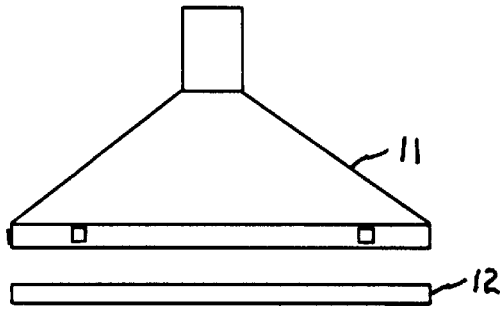
FIG. 2 is an elevation view of the CRT shown in FIG. 1 with the panel portion separated from the funnel portion.

FIG. 1 shows an intact CRT 10 having a funnel portion 11 connected to a panel portion 12 by frit glass welding or the like. The CRT 10 can be a newly manufactured CRT that failed a quality inspection, or a used or damaged CRT to be recycled. The panel portion 12 is separated from the funnel portion 11, as shown in FIG. 2, using acid to dissolve the frit glass weld and a known thermoshock process. Once separated from the funnel portion 11, the panel portion 12 can be cleaned, inspected and reused in a known manner.

Figure 3:
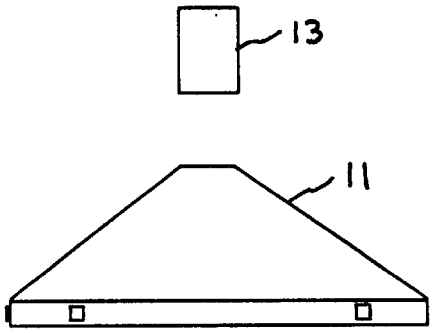
FIG. 3 is an elevation view of the CRT funnel portion shown in FIG. 2 with the CRT neck separated therefrom.
Figure 4:
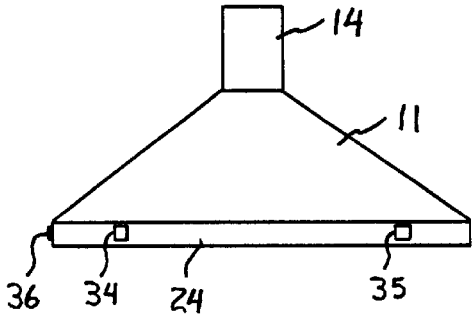
FIG. 4 is an elevation view of the CRT funnel portion with a new CRT neck attached thereto.
Figure 5:
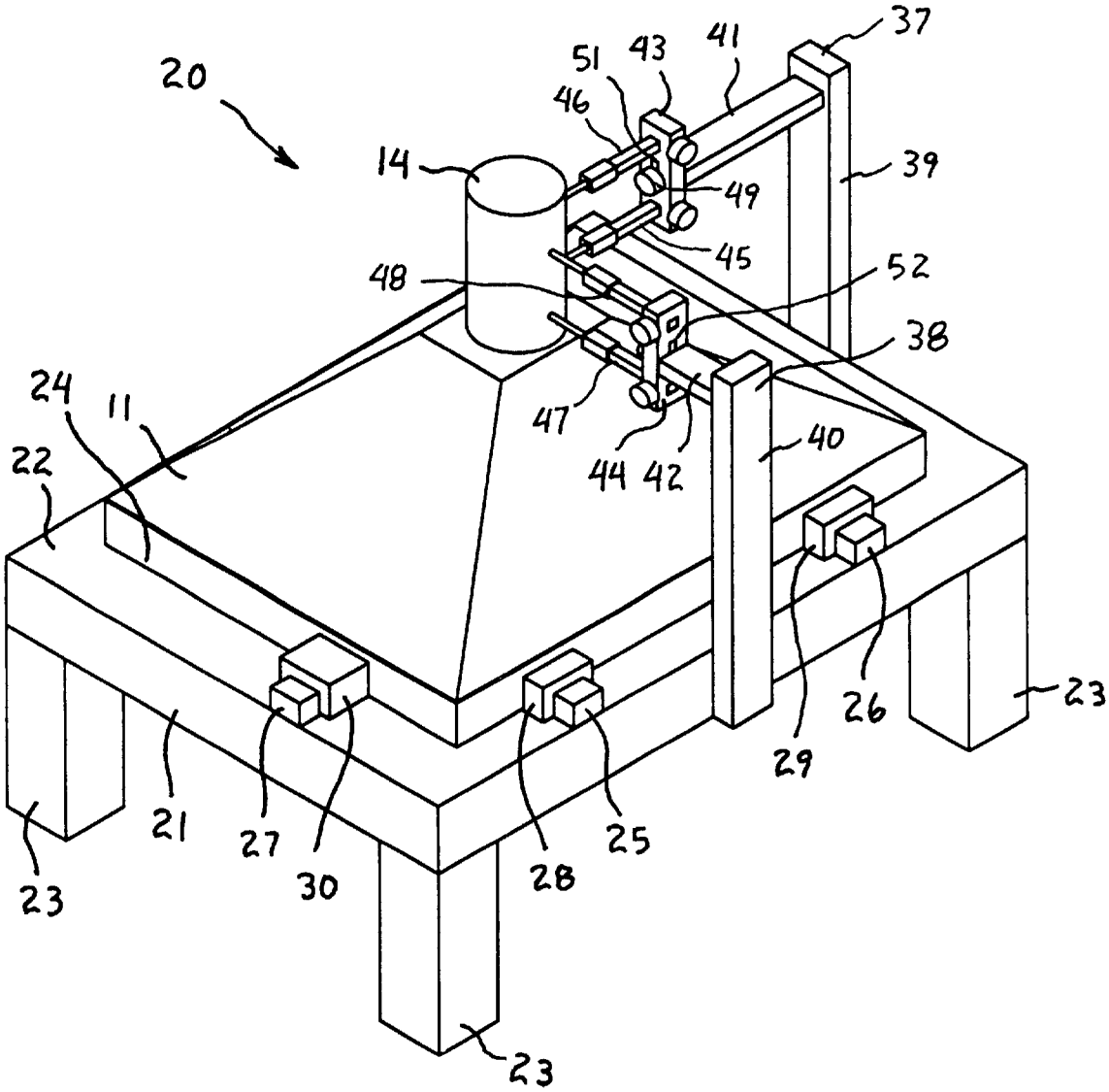
FIG. 5 is a perspective view of the CRT funnel portion and an apparatus for measuring the alignment and tilt of the reattached CRT neck according to the present invention.
Figure 6:
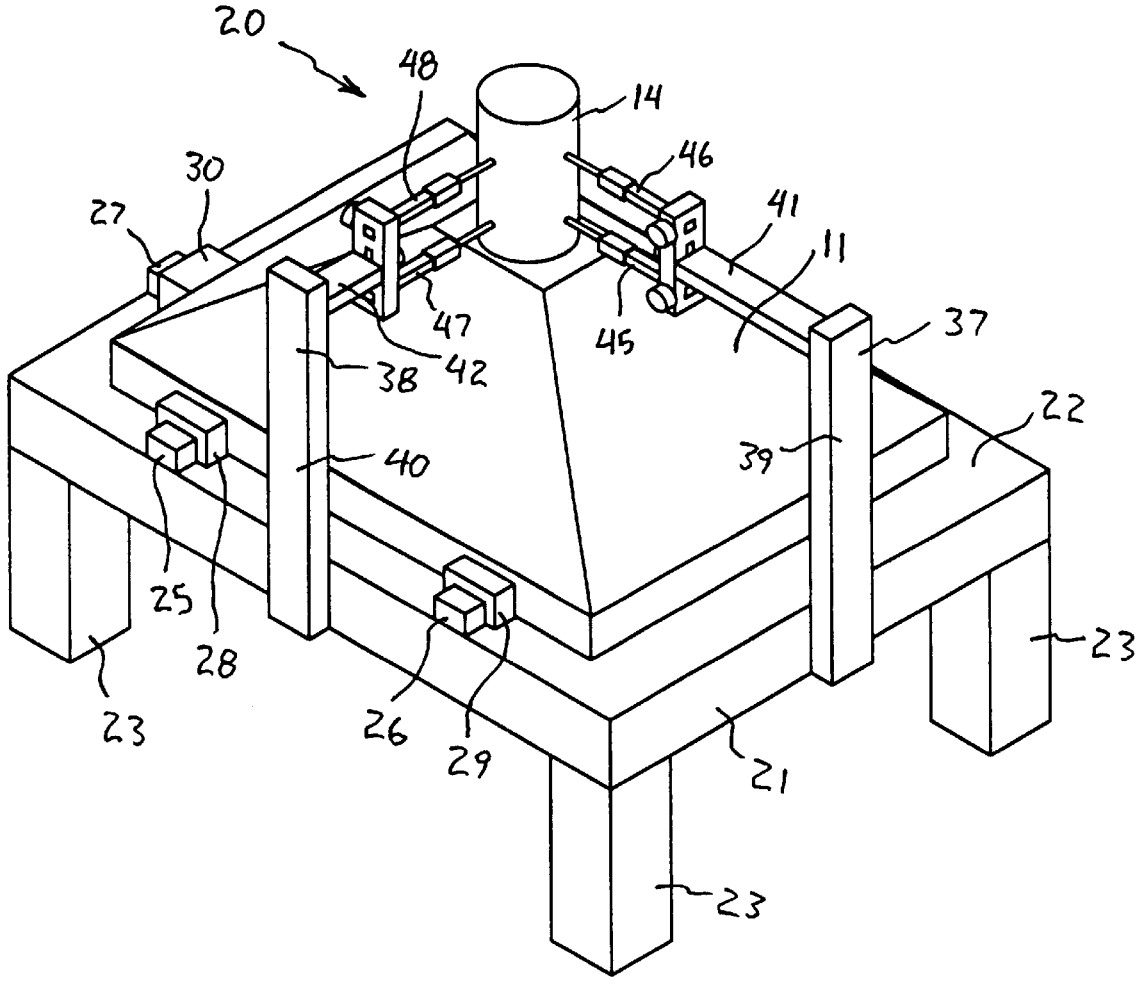
FIG. 6 is another perspective view of the CRT funnel portion and measuring apparatus shown in FIG. 5.
Figure 7:
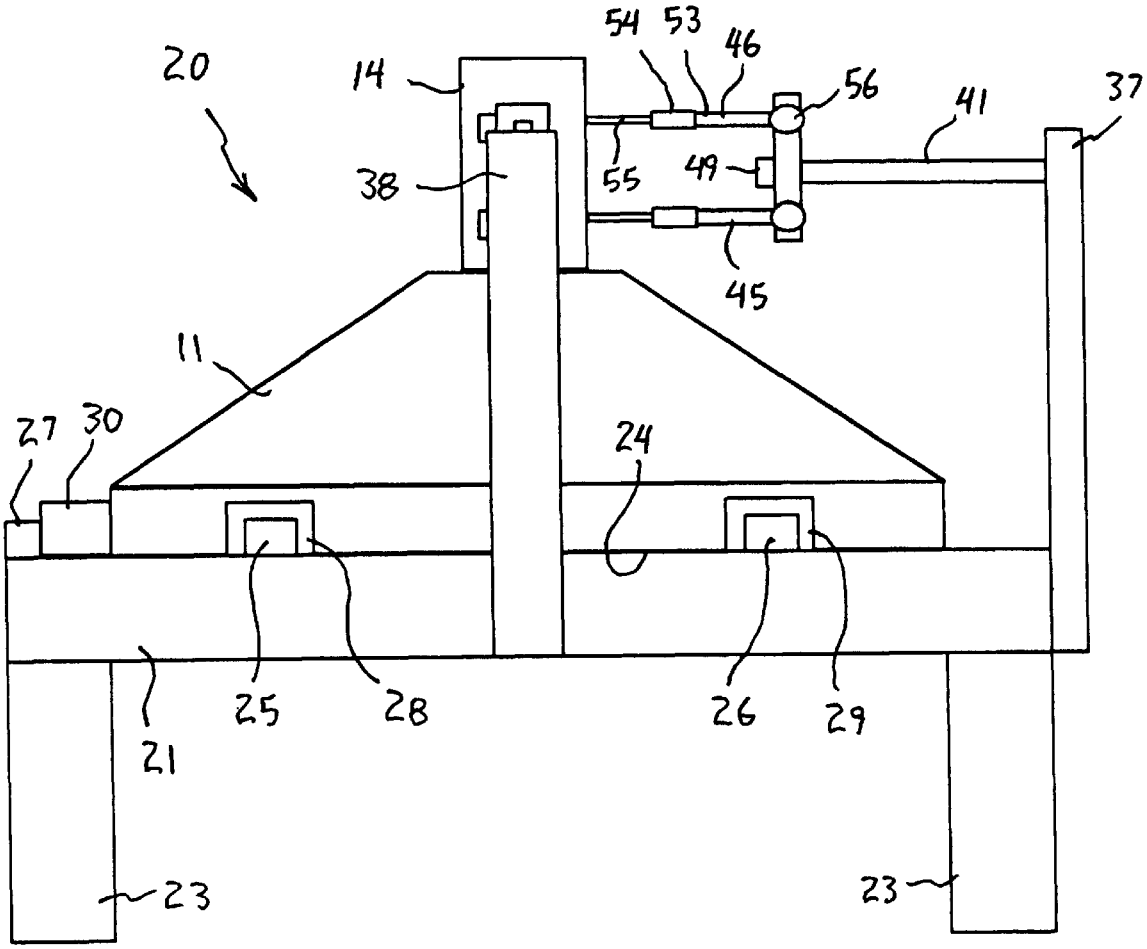
FIG. 7 is a front elevation view of the CRT funnel portion and measuring apparatus shown in FIG. 5.

The funnel portion 11 can also be reused by removing the electron gun, cutting off the CRT neck 13, as shown in FIG. 3, and re-attaching a new CRT neck 14, as shown in FIG. 4. The new CRT neck 14 is attached using a frit glass welding process or other suitable means known to those skilled in the art. An electron gun (not shown) is then inserted into the new CRT neck 14. When attaching the new CRT neck 14 to a recycled funnel portion 11, it is very important to ensure that the neck 14 is centered and not tilted. An off-center or tilted neck will cause the electron gun inserted into the neck to be misaligned, thereby causing a defective CRT.

An apparatus 20 for measuring the tilt and alignment of the new CRT neck 14 on the recycled funnel portion 11 to determine whether the CRT neck 14 is within acceptable tolerances is shown in FIGS. 5 to 8. The apparatus 20 includes a support structure 21 having a first planar surface 22 and a plurality of supporting legs 23. The planar surface 22 and supporting legs 23 together form a table-like structure. The planar surface 22 is adapted to engage and support a seal edge 24 of the CRT funnel portion 11 with the seal edge 24 facing downward. The planar surface 22 is preferably covered by a plastic material or the like to prevent scratching or chipping of the seal edge 24 or other parts of the CRT funnel portion 11 during use.

First and second stopper blocks 25, 26 are placed on the planar surface 22 along a front side of the support structure 21, and a third stopper block 27 is placed on the planar surface 22 on a left-hand side of the support structure 21. The stopper blocks 25–27 are preferably secured to the support structure 21 using a combination of pins and machine screws to provide an accurate and stable mounting of the stopper blocks 25–27. Removable stopper pads 28, 29, 30 are secured to the stopper blocks 25–27 using, for example, a combination of pins and machine screws. The removable stopper pads 28–30 each have a stopper surface 31, 32, 33 on a side thereof facing the CRT funnel portion 11. The stopper pads 28–30 are positioned at locations corresponding with the existing alignment stoppers 34, 35, 36 (FIG. 4) molded on the seal edge 24 of the CRT funnel portion 11. The stopper blocks 25–27 and stopper pads 28–30 are positioned such that the stopper surfaces 31–33 engage and align the CRT funnel portion 11 on the planar surface 22. The stopper pads 28–30, or at least the stopper surfaces 31–33 thereof, are made of a plastic material or the like to prevent scratching or chipping of the CRT funnel portion 11 during use.

First and second distance measuring assemblies 37, 38 are supported over the planar surface 22. Each measuring assembly 37, 38 includes a vertical member 39, 40, a horizontal member 41, 42, an adjustment block 43, 44, a lower gauge assembly 45, 47, and an upper gauge assembly 46, 48. The vertical members 39, 40 are secured to the support structure 21 on a front side and a right-hand side, respectively, and extend above the planar surface 22. The horizontal members 41, 42 are secured to the vertical members 39, 40 near an upper end thereof and extend inwardly toward the middle of the support structure 21. The adjustment blocks 43, 44 are connected to the horizontal members 41, 42 using threaded fasteners 49, 50 that pass through slotted openings 51, 52 in the adjustment blocks 43, 44 and into threaded openings in the ends of the horizontal members 41, 42. The slotted openings 51, 52 allow vertical adjustment of the adjustment blocks 43, 44 relative to the horizontal members 41, 42.

The lower and upper gauge assemblies 45–48 each have a gauge arm 53 received in a corresponding opening in one of the adjustment blocks 43, 44, a distance measuring dial gauge 54, and a contact member 55 extending from the dial gauge 54. The gauge-arm 53 of each gauge assembly 45–48 is adjustable in a horizontal direction toward and away from the middle of the support structure 21. The gauge arms 53 are secured in selected positions using threaded members 56 that pass through threaded bores of the adjustment blocks 43, 44 and into engagement with respective sides of the gauge arms 53.

The dial gauges 54 of each gauge assembly 45–48 are secured to the respective gauge arms 53 using threaded fasteners, adhesive, or other suitable fasteners. The dial gauges 54 are preferably digital dial gauges that detect and measure small distance changes (e.g., hundredths of millimeters) in either direction from a zero setting along a horizontal line that intersects the axial centerline of the CRT funnel portion 11. The contact members 55 of each gauge assembly 45–48 extend from the dial gauges 54 toward the axial centerline to engage the outer cylindrical surface of the CRT necks 14 attached to the CRT funnel portion 11. The measuring assemblies 37, 38 are positioned such that the contact members 55 from the first and second gauge assemblies 45, 46 engage lower and upper points on a first side of the CRT neck 14, and the contact members 55 from the third and fourth gauge assemblies 47, 48 engage lower and upper points on a second side of the CRT neck 14. The second side of the CRT neck 14 is circumferentially spaced 90 degrees from the first side.

In operation, the CRT funnel portion 11 is placed on the planar surface 22 of the support structure 21 with the seal edge 24 facing downward. The CRT funnel portion 11 is then slid on the planar surface 22 until the three alignment stoppers 34–36 molded on the glass seal edge 24 are engaged with the stopper surfaces 31–33 of the three stopper pads 28–30. In this position, the contact members 55 of the dial gauge assemblies 45–48 are in contact with respective points on the cylindrical outer surface of the CRT neck 14.

Figure 8:
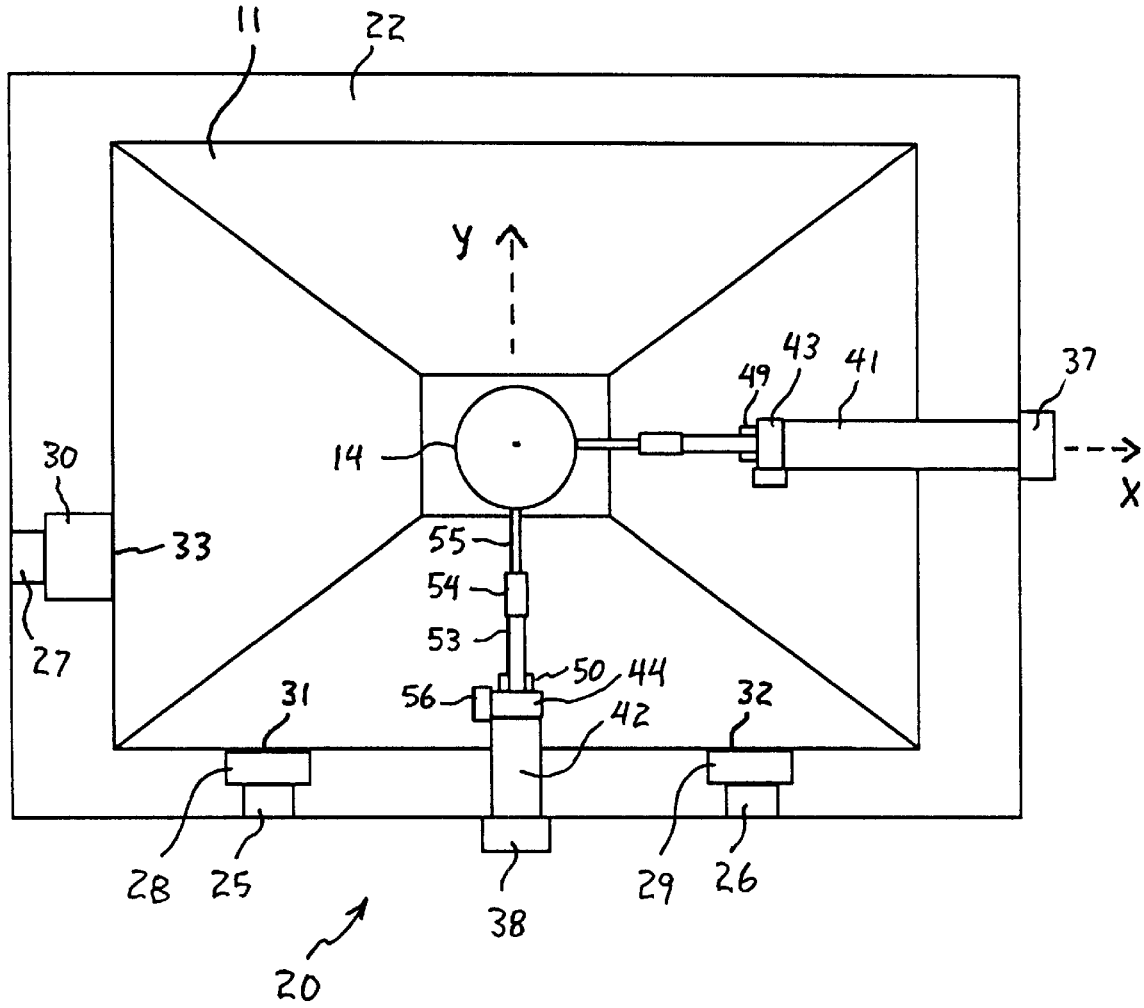
FIG. 8 is a plan view of the CRT funnel portion and measuring apparatus shown in FIG. 5.

The alignment or centering of the CRT neck 14 on the CRT funnel portion 11 is measured by taking readings from the dial gauges 54 of the first and third gauge assemblies 45, 47. As described above, the first and third gauge assemblies 45, 47 have contact members 55 that engage the lower points on each of the first and second sides of the CRT neck 14, respectively. Any offset of the CRT neck 14 in the X and Y directions, as shown in the plan view of FIG. 8, is detected by the first and third gauge assemblies 45, 47.

The tilt of the CRT neck 14 on the CRT funnel portion 11 is measured by taking readings from all four of the gauge assemblies 45–48 and comparing the gauge readings from the lower and upper points on each of the first and second sides of the CRT neck 14. For example, tilt in the X direction is calculated by taking the reading from the lower gauge assembly 45 minus the reading from the upper gauge assembly 46 on the first side. Tilt in the Y direction is similarly calculated by comparing the readings from the lower and upper gauge assemblies 47, 48 on the second side.

Figure 9:
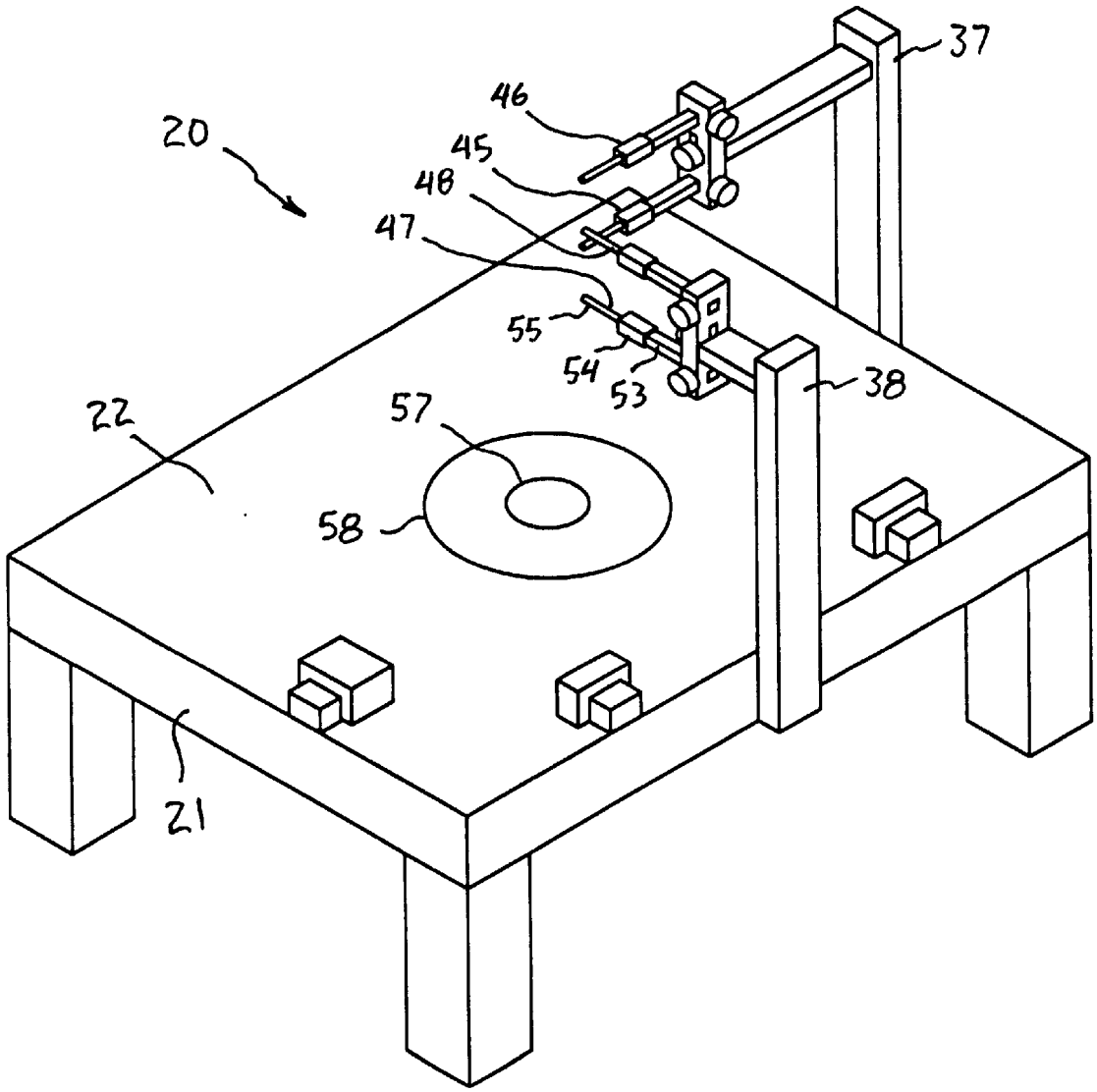
FIG. 9 is a perspective view of the measuring apparatus shown in FIG. 5 with the CRT funnel portion removed.

FIG. 9 shows the measuring apparatus 20 with the CRT funnel portion 11 removed. As shown in FIG. 9, the planar surface 22 of the support structure 21 has a machined centering bore 57 in its middle at precisely where the axial centerline of the CRT funnel portion 11 should be located. A machined counterbore 58 is provided around the centering bore 57. A centering post 59, as shown in FIG. 10, has a machined lower end 60 that fits snugly into the centering bore 57, and an annular base 61 that fits into the counterbore 58. FIG. 11 shows the centering post 59 positioned on the support structure 21. The centering post 59 can be secured to the support structure 21 using threaded bolts or other suitable fasteners to enhance the accuracy and repeatability of the calibration.

The centering post 59 has an upper cylindrical portion 62 with a cylindrical outer surface having an outer dimension that corresponds to a desired alignment and tilt of the CRT neck 14 to be measured. The centering post 59 therefore provides a structure that can be used to calibrate the gauges 54 of the gauge assemblies 45–48, particularly for the tilt measurements. The gauge assemblies 45–48 can also be calibrated using actual glass funnel samples having known neck offset and/or tilt values.

Figure 12:
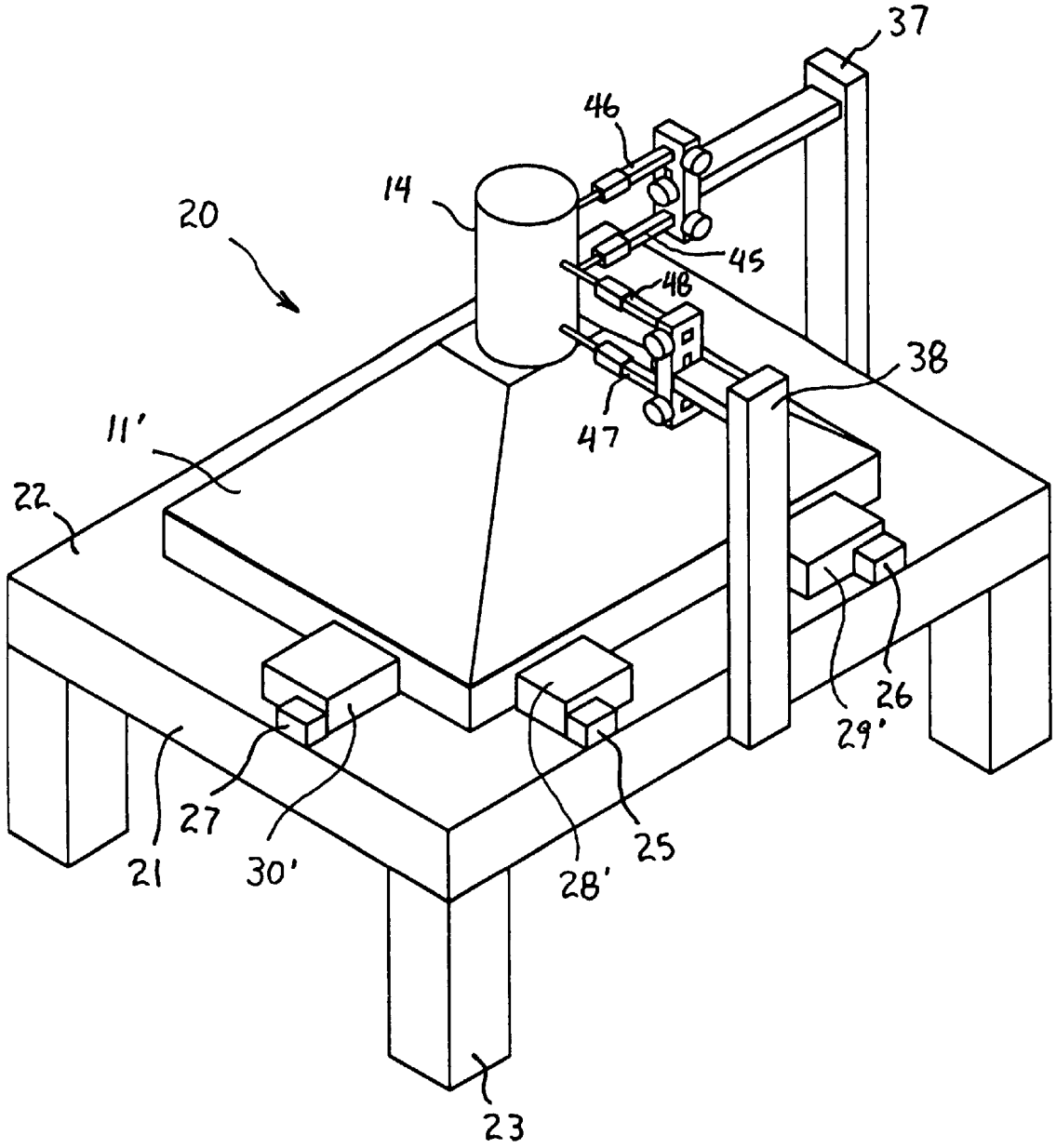
FIG. 12 is a perspective view of the measuring apparatus arranged to receive a smaller-size CRT funnel portion.

FIG. 12 shows the apparatus 20 being used with a smaller size CRT funnel portion 11' than the CRT funnel portion 11' shown in FIGS. 5 to 8. To accommodate and properly align the smaller size CRT funnel portion 11', a different set of stopper pads 28', 29', 30' are secured to the stopper blocks 25–27. The different set of stopper pads 28', 29', 30' change the distance between the stopper blocks 25–27 and the molded alignment surfaces 34–36 of the smaller size CRT funnel portion 11'. As a result, the same measuring apparatus 20 can be changed quickly and efficiently to accommodate a variety of CRT funnel sizes.

The measuring apparatus 20 of the present invention provides an accurate and highly repeatable measuring system for its intended purpose. Test results showed a deviation from the standard glass funnel limit samples of less than 0.05 mm and a Sigma level between 5 and 8 sigma, meaning the variation from reading to reading was very close to target and centered between the upper and lower specifications. The ease of use and stable readings of the measuring apparatus 20 are preferred over the traditional 3-point systems typically used by CRT manufacturers.

While the invention has been specifically described in connection with specific embodiments thereof, it is to be understood that this is by way of illustration and not of limitation, and the scope of the appended claims should be construed as broadly as the prior art will permit.

What is claimed is:

1. An apparatus for measuring alignment and tilt of CRT necks attached to recycled CRT funnel portions, the CRT necks each having an axial center line and an outer surface which is generally cylindrical, the apparatus comprising:

a support structure having a first surface adapted to engage and support a seal edge of a CRT funnel portion;

at least two stopper surfaces extending from the support structure and adapted to engage respective alignment stoppers molded on the CRT funnel portion to position the CRT funnel portion on the support structure;

first and second distance measuring gauges mounted to said support structure, each of said first and second gauges having respective engagement portions adapted to engage the outer surface of a CRT neck being measured, the engagement portions of the first and second gauges being positioned on a first side of the CRT neck and facing the axial center line thereof with the first gauge being positioned below the second gauge; and third and fourth distance measuring gauges mounted to said support structure, each of said third and fourth gauges having respective engagement portions adapted to engage the outer surface of the CRT neck being measured, the engagement portions of the third and fourth gauges being positioned on a second side of the CRT neck and facing the axial center line thereof with the third gauge being positioned below the fourth gauge.

2. The apparatus as set forth in claim 1, wherein said first and second gauges are arranged to measure distances in a first direction, said third and fourth gauges are arranged to measure distances in a second direction, and said first direction is approximately perpendicular to said second direction.

3. The apparatus as set forth in claim 1, wherein said first, second, third and fourth gauges are digital dial gauges, and said first and second gauges are arranged generally perpendicular to said third and fourth gauges.

4. The apparatus as set forth in claim 1, further comprising a removable centering post for calibrating the gauges, the centering post having a lower end for engaging and aligning with the support structure and an upper end having an outer dimension corresponding to an outer surface of a CRT neck.

5. The apparatus as set forth in claim 4, wherein said support structure has a bore formed therein which is coaxial with the axial center line of the CRT neck, and the lower end of said centering post is sized to fit snugly into said bore.

6. The apparatus as set forth in claim 1, wherein said first, second, third and fourth gauges are each mounted to respective adjustment mechanisms which are adjustable to move the engagement portions toward and away from the axial center line of the CRT neck.

7. The apparatus as set forth in claim 1, wherein said first surface is generally planar, and said at least two stopper surfaces comprise three stopper surfaces that extend generally perpendicular to said first surface and are positioned to engage three respective alignment stoppers molded on a CRT funnel portion.

8. The apparatus as set forth in claim 1, wherein said at least two stopper surfaces comprises a first set of stopper surfaces to engage alignment stoppers molded on a CRT funnel portion of a first size, and a second set of stopper surfaces to engage alignment stoppers molded on a CRT funnel portion of a second size which is different from said first size.

9. An apparatus for measuring alignment and tilt of a cylindrical member attached to a funnel-shaped member, the cylindrical member having an axial center line, the apparatus comprising:

a support structure having a first surface adapted to engage and support the funnel-shaped member;

at least two stopper surfaces connected to the support structure for engaging corresponding surfaces of the funnel-shaped member to position the funnel-shaped member on the support structure;

first and second distance measuring gauges mounted to said support structure, each of said first and second gauges having respective engagement portions adapted to engage the outer surface of the cylindrical member being measured, the engagement portions of the first and second gauges being positioned on a first side of the cylindrical member and facing the axial center line thereof with the first gauge being positioned below the second gauge; and third and fourth distance measuring gauges mounted to said support structure, each of said third and fourth gauges having respective engagement portions adapted to engage the outer surface of the cylindrical member being measured, the engagement portions of the third and fourth gauges being positioned on a second side of the cylindrical member and facing the axial center line thereof with the third gauge being positioned below the fourth gauge.

10. The apparatus as set forth in claim 9, wherein said first and second gauges are arranged to measure distances in a first direction, said third and fourth gauges are arranged to measure distances in a second direction, and said first direction is approximately perpendicular to said second direction.

11. The apparatus as set forth in claim 9, wherein said first, second, third and fourth gauges are digital dial gauges, and said first and second gauges are arranged generally perpendicular to said third and fourth gauges.

12. The apparatus as set forth in claim 9, further comprising a removable centering post for calibrating the gauges, the centering post having a lower end for engaging and aligning with the support structure and an upper end having a cylindrical outer surface with an outer dimension corresponding to the cylindrical member.

13. The apparatus as set forth in claim 9, wherein said first, second, third and fourth gauges are each mounted to respective adjustment mechanisms which can be adjusted to move the respective engagement portions toward and away from the axial center line.

14. The apparatus as set forth in claim 9, wherein said at least two stopper surfaces comprises a first set of stopper surfaces for engaging a funnel-shaped member of a first size, and a second set of stopper surfaces for engaging a funnel-shaped member of a second size which is different from said first size.

* * * * *